US006718958B2

(12) United States Patent
Shimizu

(10) Patent No.: US 6,718,958 B2
(45) Date of Patent: Apr. 13, 2004

(54) IGNITION APPARATUS FOR AN INTERNAL COMBUSTION ENGINE

(75) Inventor: Takeshi Shimizu, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/289,438

(22) Filed: Nov. 7, 2002

(65) Prior Publication Data

US 2003/0230292 A1 Dec. 18, 2003

(30) Foreign Application Priority Data

Jun. 13, 2002 (JP) ..... 2002-172636

(51) Int. Cl.[7] ..... F02P 1/00

(52) U.S. Cl. ..... 123/594; 123/143 C; 123/634; 336/96

(58) Field of Search ..... 123/594, 621, 123/634, 635, 143 C; 336/96, 107

(56) References Cited

U.S. PATENT DOCUMENTS 4,181,114 A * 1/1980 Carlsson et al. ..... 123/601
4,568,903 A * 2/1986 Buckley ..... 336/197
4,746,890 A * 5/1988 Buckley et al. ..... 336/197
4,903,674 A * 2/1990 Bassett et al. ..... 123/634
4,949,917 A * 8/1990 Cottle et al. ..... 244/3.16
5,125,386 A * 6/1992 De Filippis et al. ..... 123/634
5,218,936 A * 6/1993 Pritz et al. ..... 123/143 C
5,697,352 A * 12/1997 Shimizu et al. ..... 123/634
6,332,458 B1 * 12/2001 Shimada et al. ..... 123/634
6,639,498 B2 * 10/2003 Shimada et al. ..... 336/96

FOREIGN PATENT DOCUMENTS

JP 7-335457 12/1995

* cited by examiner

*Primary Examiner*—John Kwon
(74) *Attorney, Agent, or Firm*—Sughrue Mion, PLLC

(57) ABSTRACT

An operation of connecting primary coils and a wiring module of an ignition apparatus for an internal combustion engine is carried out smoothly. The ignition apparatus includes a casing (8), closed magnetic circuit cores (2), primary coils (4) each having primary coil connector terminals (40*a*, 40*b*) at their opposite ends, respectively, and secondary coils (6) having secondary coil connector terminals (6*a*). A wiring module (9) is composed of a plurality of wires integrally formed with each other through a resin for supplying current to the primary coils (4). A resin portion (11) is filled into the casing (8) to fixedly attach transformers (1A, 1B, 1C) to the casing (8). A positioning element (9*c*, 40*c*) is arranged between the primary coils (4) and the wiring module (9) to position the relative positions of the primary coil connector terminals (40*a*, 40*b*) and module connector terminals (10*a*, 10*c*).

5 Claims, 9 Drawing Sheets

IGNITION APPARATUS FOR AN INTERNAL COMBUSTION ENGINE

BACKGROUND OF THE INVENTION

1. Field of the Invention

The present invention relates to an ignition apparatus for an internal combustion engine which supplies a high voltage to a spark plug for each engine cylinder.

2. Description of the Related Art

FIG. 7 is a plan view of an ignition apparatus 1 for an internal combustion engine shown in Japanese Patent Laid-Open No. Hei 7-29751. FIG. 8 is a cross sectional view of the ignition apparatus 1 for an internal combustion engine taken along line VIII—VIII in FIG. 7. FIG. 9 is a plan view of a wiring module 9 shown in FIG. 9. FIG. 10 is a view of the wiring module 9 when seen from arrow A in FIG. 9. FIG. 11 is an electric circuit diagram of the ignition apparatus 1 for an internal combustion engine shown in FIG. 7.

The ignition apparatus 1 illustrated is used by a simultaneous ignition system for an internal combustion engine, that is, the opposite ends of a secondary coil 6 of each transformer are connected with two spark plugs. The ignition apparatus 1 is provided with three transformers 1A, 1B, 1C, and is used for an internal combustion engine having six cylinders.

The first through third transformers 1A, 1B, 1C of the ignition apparatus 1 are built into a casing 8 that is molded with a resin and has a plurality of high-voltage towers 8*a* formed at its head. Each of the first through third transformers 1A, 1B, 1C includes a closed magnetic circuit core 2 which forms a hollow-rectangular-shaped closed magnetic circuit, a primary coil 4 which has a conducting wire wound around a primary bobbin 3 surrounding the closed magnetic circuit core 2, and a secondary coil 6 which has a conducting wire wound around a secondary bobbin 5 surrounding the primary coil 4. The first through third transformers 1A, 1B, 1C are fixed to the casing 8 through a resin portion 11 made of a thermosetting resin such as an epoxy resin.

The conducting wire of each primary coil 4 is connected at one end thereof with a corresponding module connector terminal 10*a* that is one of three first ends of a first wire 10A, and the other or second end of the first wire 10A forms a connector terminal 10*b*. The connector terminal 10*b* is electrically connected with an external connector terminal through which it is finally connected with a power supply (not shown) such as the battery of a vehicle. The conducting wire of each primary coil 4 is connected at the other end thereof with a module connector terminal 10*c* that is one end of a corresponding one of three second wires 10B, and the other end of each second wire 10B forms a connector terminal 10*d*. The connector terminal 10*d* of each second wire 10B is electrically connected with an external terminal through which it is finally connected with a corresponding terminal of a switching module (not shown), e.g., a collector of a corresponding one of power transistors which constitute the switching module.

The conducting wire of each secondary coil 6 is connected at its opposite ends with external output terminals 8*b* of the high-voltage towers 8*a*, respectively.

The first wire 10A and the second wires 10B are integrally formed with each other through a resin to form the wiring module 9, as shown in FIG. 9.

With the known ignition apparatus for an internal combustion engine as constructed above, the respective transformers 1A, 1B, 1C are arranged in the casing 8 with which the wiring module 9 is integrally formed beforehand, and thereafter the conducting wire of each primary coil 4 is connected at one end thereof with a corresponding module connector terminal 10*a* of the first wire 10A, and at the other end thereof with the module connector terminal 10*c* of a corresponding second wire 10B. Also, the conducting wire of each secondary coil 6 is connected at its opposite ends with the corresponding external output terminals 8*b* of the high-voltage towers 8*a*. Then, a resin such as an epoxy resin is casted into the casing 8 under a vacuum atmosphere, and solidified or cured in a curing oven at a high temperature to form the resin portion 11. In this manner, the fixing of the respective transformers 1A, 1B, 1C and the insulation of a high voltage can be achieved.

Now, the operation of the known ignition apparatus 1 for an internal combustion engine as constructed above will be explained below.

When coil drivers (not shown) such as power transistors are driven by a control signal from a control unit (not shown) of the internal combustion engine, a primary current flowing through the primary coils 4 is controlled to be supplied and interrupted in an appropriate manner by the coil drivers.

That is, the coil drivers are turned off at prescribed ignition timing of the internal combustion engine thereby to cut off the primary current of the corresponding primary coils 4, whereupon counterelectromotive forces are generated in the primary coils 4 whereby high voltages are produced in the secondary coils 6 of the transformers 1A, 1B, 1C. As a result, the high voltages thus produced are impressed on the spark plugs (not shown) connected with the secondary coils 6, whereby air fuel mixtures in the unillustrated engine cylinders are dielectrically broken down, and fired by sparking of the corresponding spark plugs caused by discharging of secondary current flowing through the respective secondary coils.

With the known ignition apparatus 1 for an internal combustion engine as described above, when the respective transformers 1A, 1B, 1C are arranged in the casing 8, the relative positions among the module connector terminals 10*a* of the first wire 10A, the module connector terminals 10*c* of the second wires 10B of the wiring module 9 integrally formed with the casing 8 and the respective ends of the conducting wires of the primary coils 4 have not been fixed, and hence the positional adjustment of the module connector terminals 10*a* and the one ends of the conducting wires of the respective primary coils 4 as well as the positional adjustment of the module connector terminals 10*c* and the other ends of the conducting wires of the respective primary coils 4 are individually performed and then welded to each other through welding operation. Therefore, there arises the following problem. That is, the positional adjustment of each primary coil 4 and the wiring module 9 takes time, and in particular, the increased number of transformers 1A, 1B, 1C results in an accordingly increased time for connecting operation.

SUMMARY OF THE INVENTION

The present invention is intended to obviate the above-mentioned problem, and has for its object to provide an ignition apparatus for an internal combustion engine in which the positional adjustment of primary coil connector terminals and module connector terminals can be performed with ease, thus making it possible to smoothly carry out the operation of electrically connecting primary coils and a wiring module with each other.

Bearing the above object in mind, the present invention resides in an ignition apparatus for an internal combustion engine including: a casing; a closed magnetic circuit core incorporated in the casing and having sides; a primary coil arranged to surround a part of the sides of the closed magnetic circuit core and having primary coil connector terminals at its opposite ends; and a secondary coil arranged to surround the primary coil and having secondary coil connector terminals at its opposite ends for outputting a high voltage when a current supplied to the primary coil is turned on and off. A wiring module is provided which has module connector terminals connected with the primary coil connector terminals. The wiring module is composed of a plurality of wires integrally formed with each other through a resin for supplying the current to the primary coil. A resin portion is filled in the casing to fixedly attach the closed magnetic circuit core, the primary coil and the secondary coil to an inner surface of the casing. A positioning element, which preferably includes concave portions formed in the primary coil connector terminals and ribs formed on the wiring module and fitted into the concave portions, is arranged between the primary coil and the wiring module for positioning the relative positions of the primary coil connector terminals and the module connector terminals. According to the above arrangement, the positional adjustment of the primary coil connector terminals and the module connector terminals can be easily performed, thus making it possible to carry out the operation of electrically connecting the primary coil and the wiring module with each other in a smooth manner.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Hereinafter, preferred embodiments of the present invention will be described in detail while referring to the accompanying drawings, with the same or corresponding parts or members thereof as the above-mentioned known ones being identified by the same symbols.

Embodiment 1.

Figure 1:
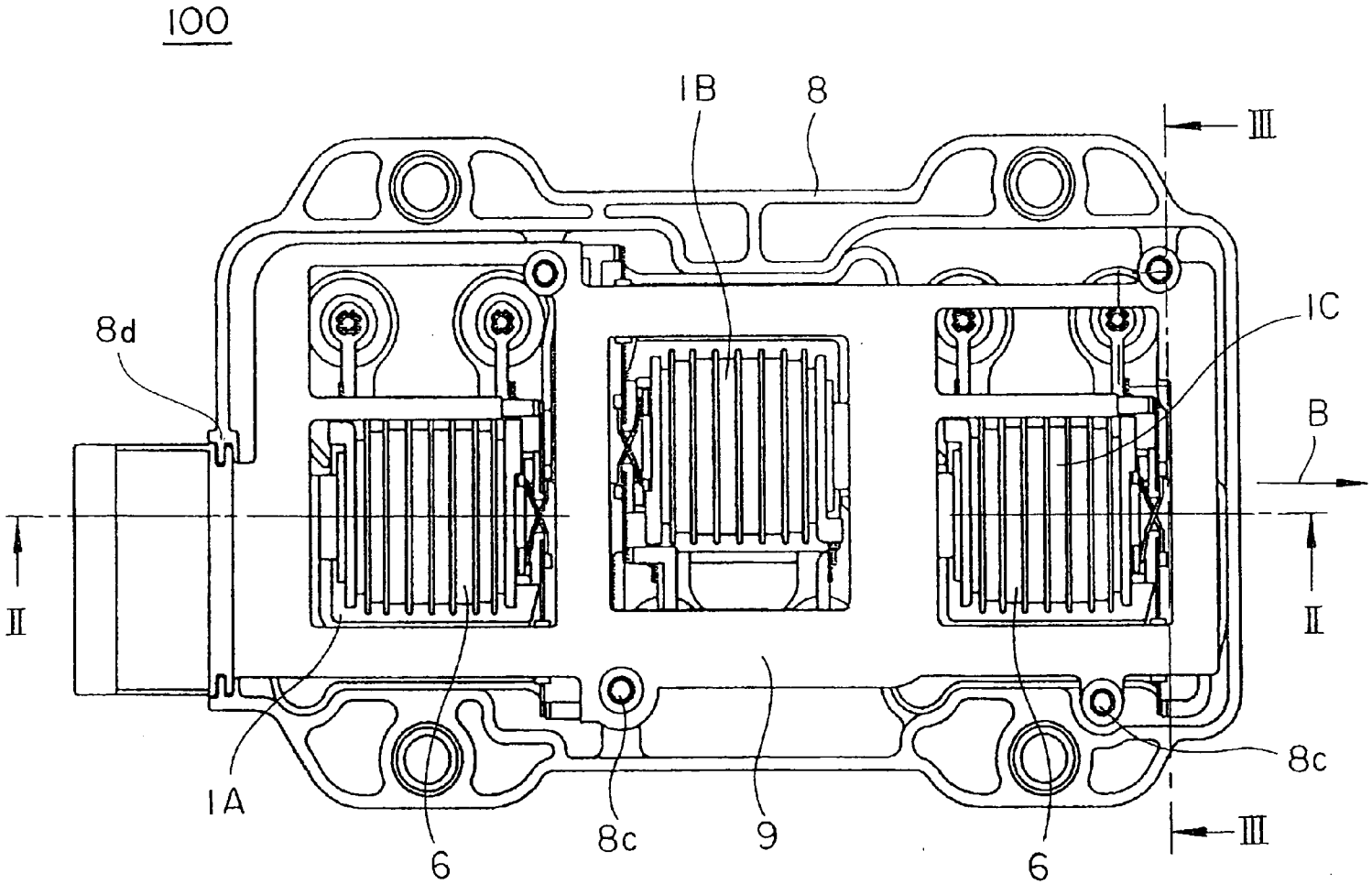
FIG. 1 is a view showing an ignition apparatus for an internal combustion engine according to the present invention when seen from an opening side of a casing, with a casting resin being omitted.
Figure 2:
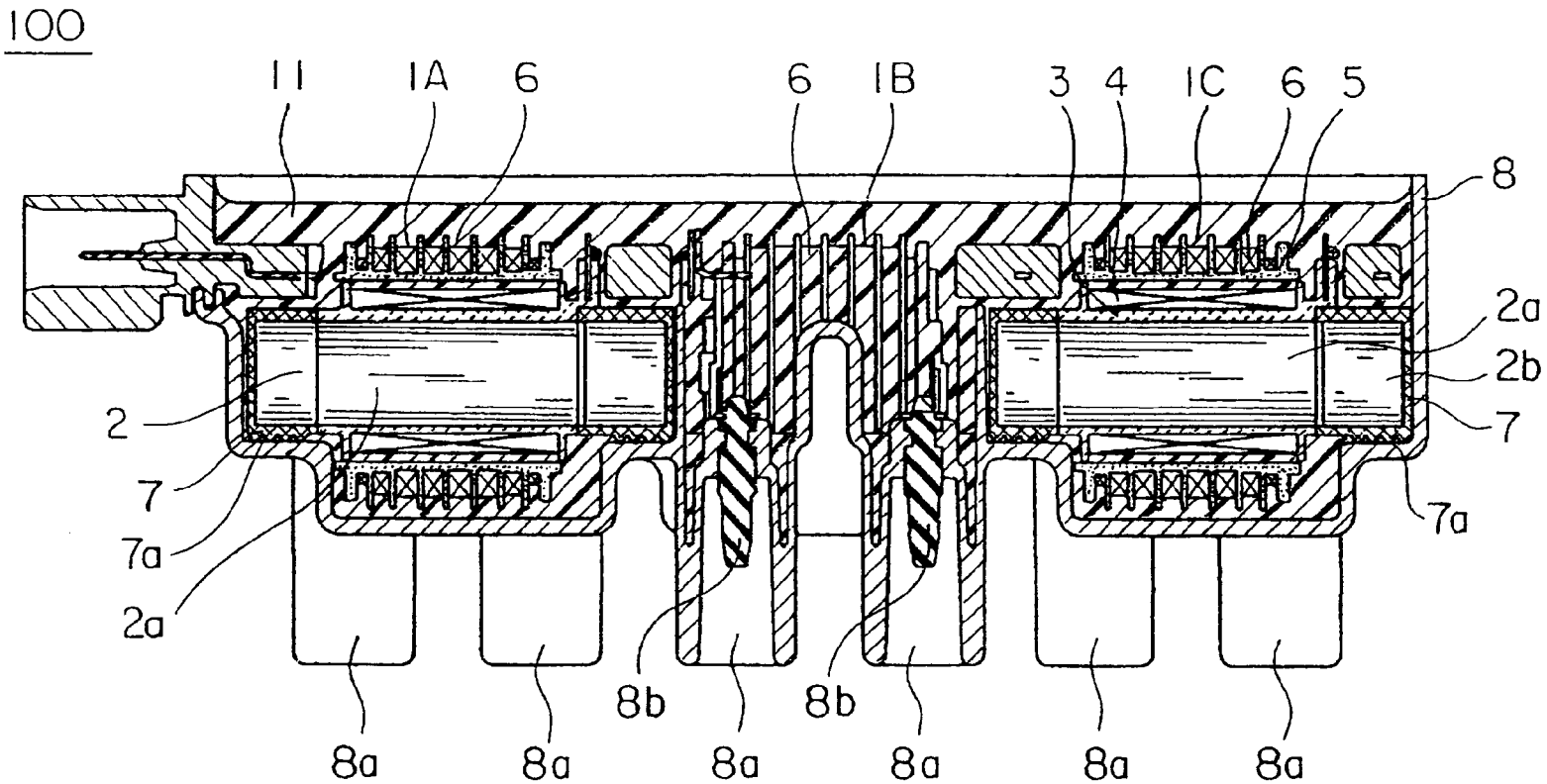
FIG. 2 is a cross sectional view taken along line II—II of FIG. 1.
Figure 3:
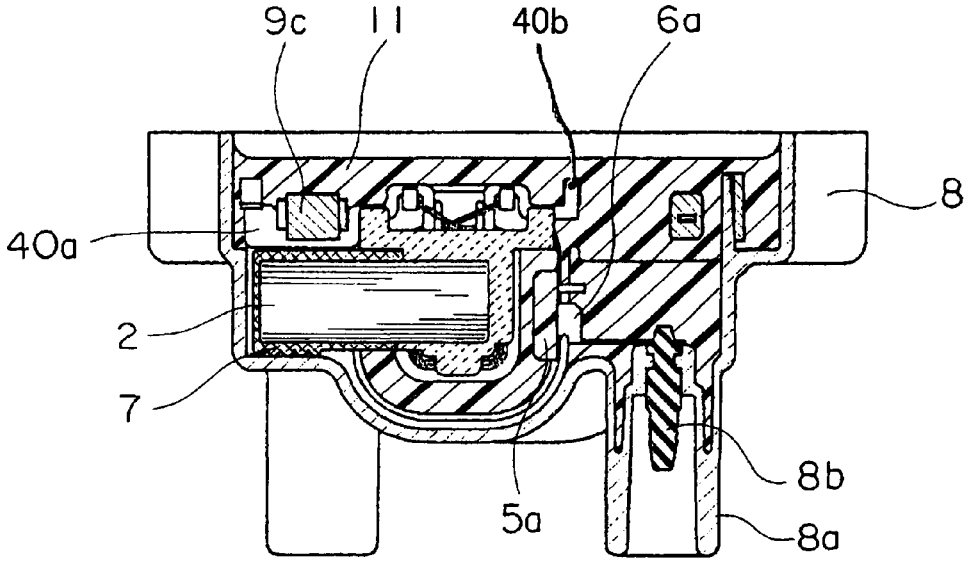
FIG. 3 is a cross sectional view taken along line III—III of FIG. 1.
Figure 4:
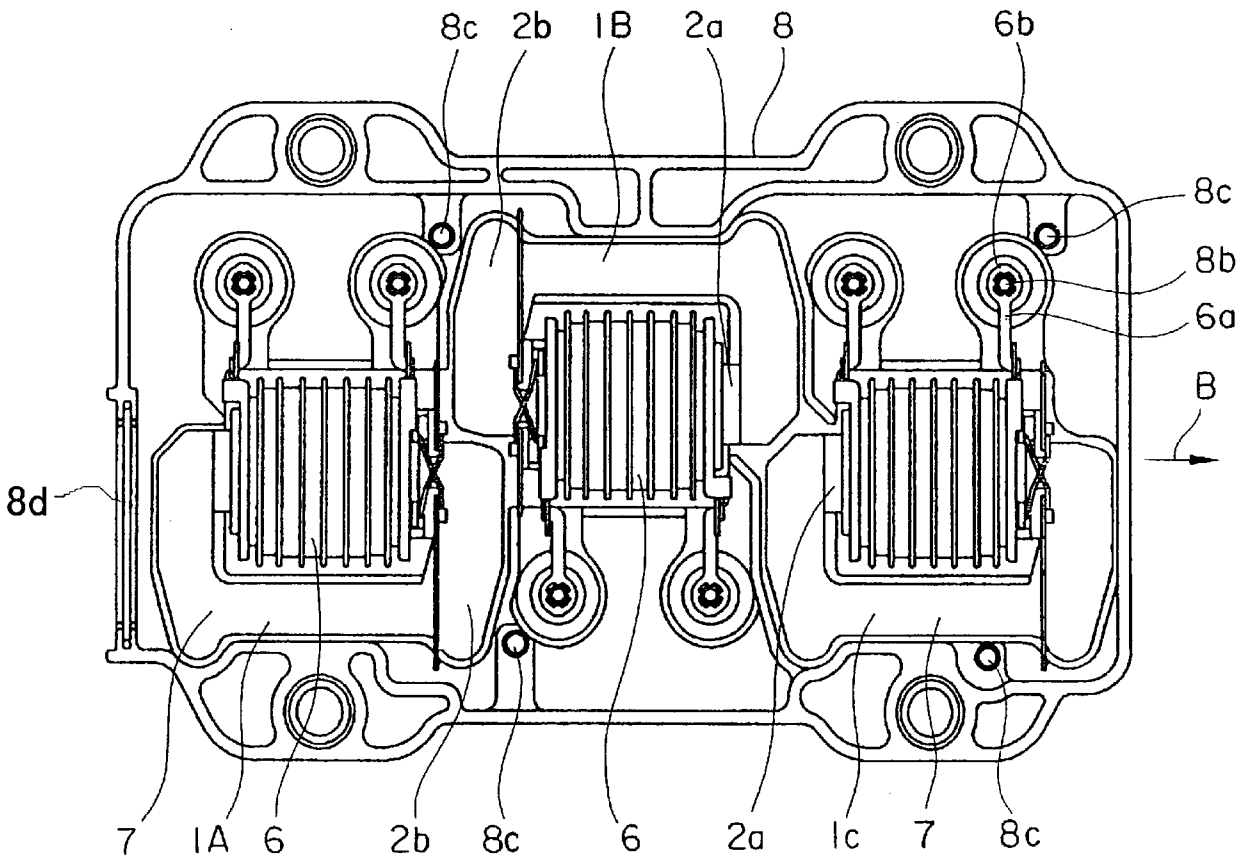
FIG. 4 is a view similar to FIG. 1 with a wiring module being removed.
Figure 5:
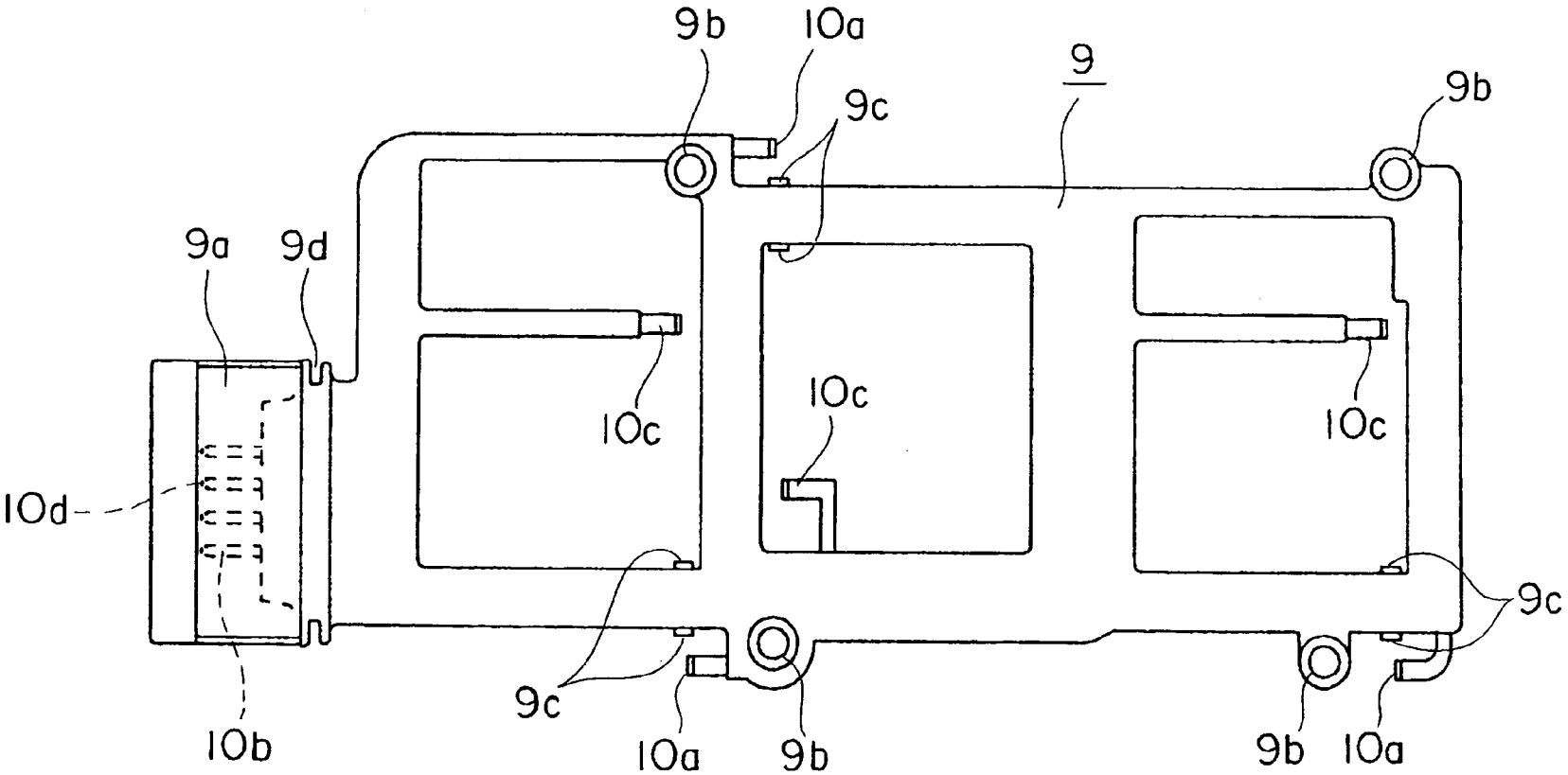
FIG. 5 is a plan view of the wiring module of FIG. 1.
Figure 6:
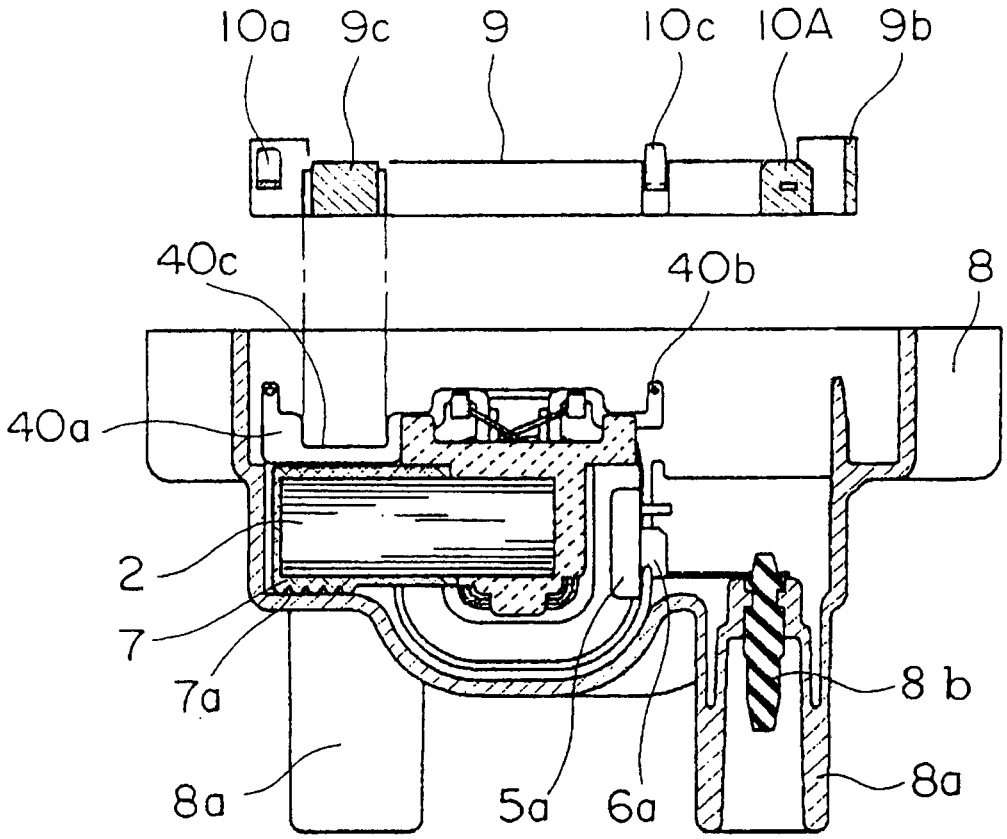
FIG. 6 is a cross sectional view of the ignition apparatus of FIG. 1 before the wiring module is built into the casing.
Figure 7:
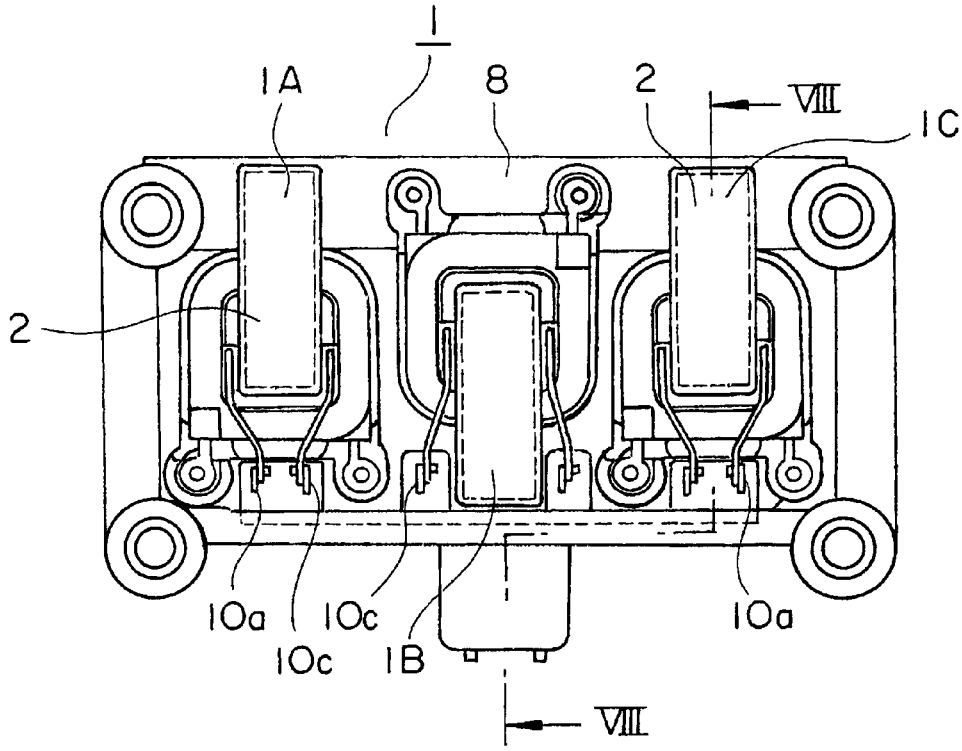
FIG. 7 is a plan view of a known ignition apparatus for an internal combustion engine shown in Japanese Patent Laid-Open No. Hei 7-29751.
Figure 8:
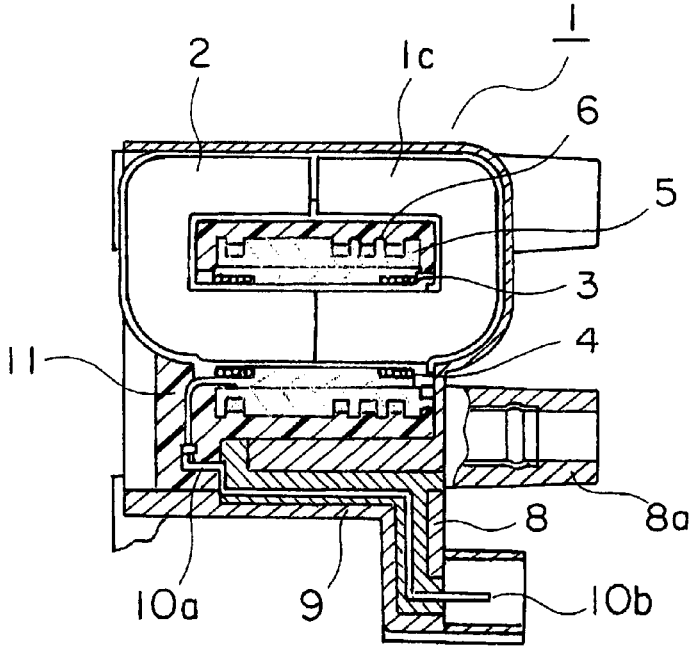
FIG. 8 is a cross sectional view of the known ignition apparatus for an internal combustion engine taken along line VIII—VIII of FIG. 7.
Figure 9:
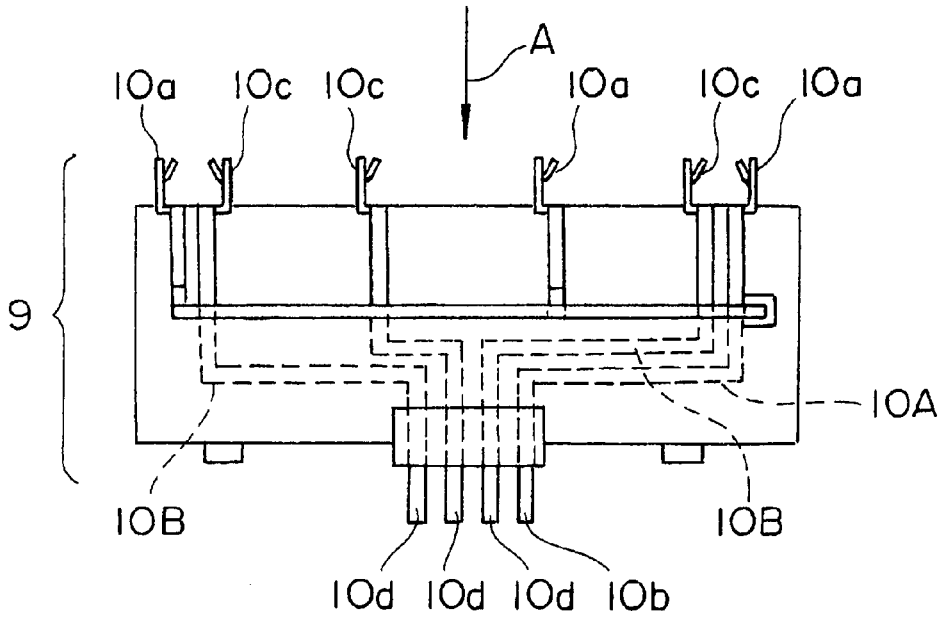
FIG. 9 is a plan view of a wiring module shown in FIG. 7.
Figure 10:
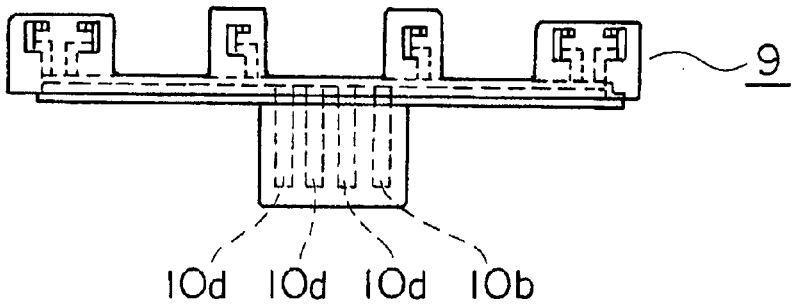
FIG. 10 is a view of the wiring module when seen from arrow A in FIG. 9.
Figure 11:
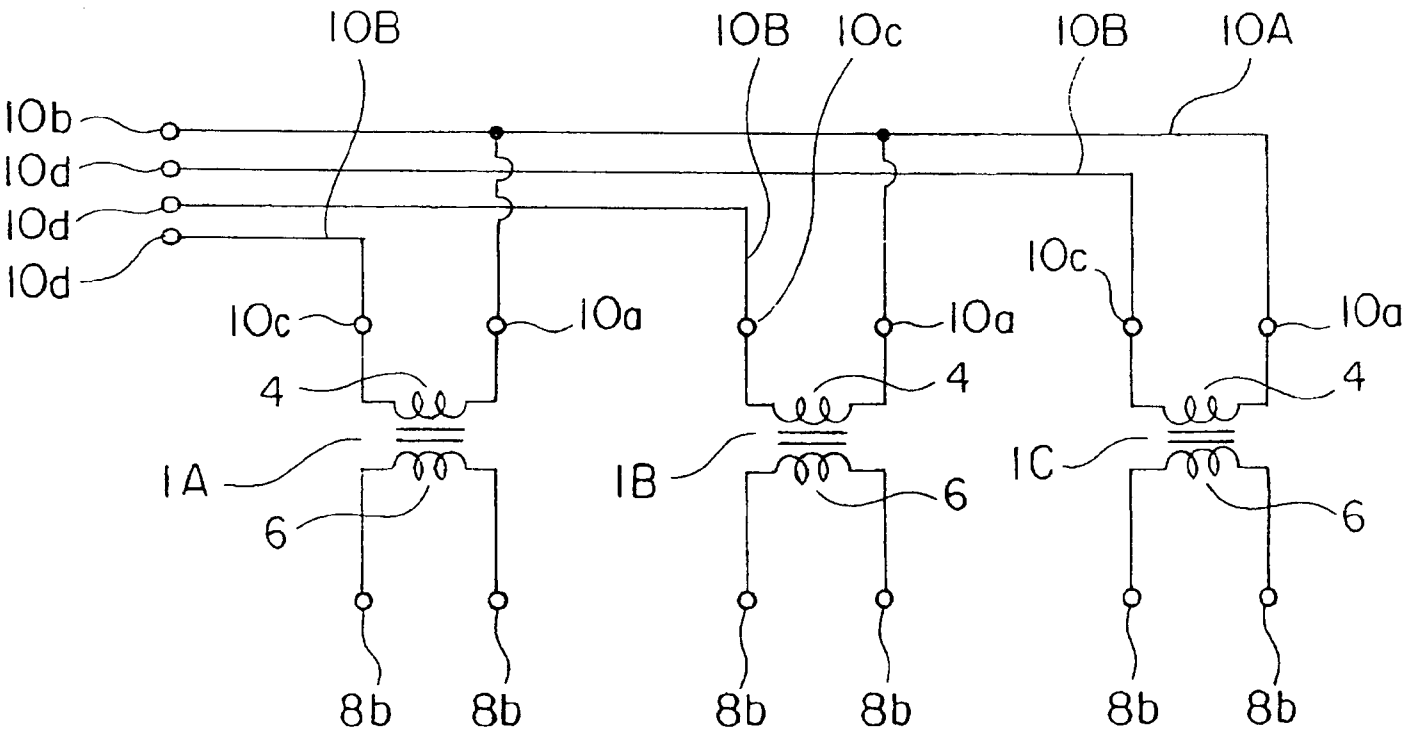
FIG. 11 is an electric circuit diagram of the known ignition apparatus for an internal combustion engine shown in FIG. 7.

FIG. 1 is a view of an ignition apparatus for an internal combustion engine according to a first embodiment of the present invention when seen from an opening side of a casing 8, with a resin portion 11 being omitted. FIG. 2 is a cross sectional view taken along line II—II of FIG. 1. FIG. 3 is a cross sectional view taken along line III—III of FIG. 1. FIG. 4 is a view of the ignition apparatus with a wiring module 9 in FIG. 1 being removed. FIG. 5 is a plan view of the wiring module 9 shown in FIG. 1. FIG. 6 is a cross sectional view of the ignition apparatus of FIG. 1 before the wiring module 9 is built into the casing 8.

In this ignition apparatus 100 for an internal combustion engine, the conducting wire of each secondary coil 6 has secondary coil connector terminals 6*a* at its opposite ends which are finally connected electrically with two spark plugs (not shown). The ignition apparatus 1 is provided with three transformers 1A, 1B, 1C, and is used for an internal combustion engine having six cylinders.

The first through third transformers 1A, 1B, 1C of the ignition apparatus 1 are built into the casing 8 that is molded with a resin and has a plurality of high-voltage towers 8*a* formed at its head. Each of the first through third transformers 1A, 1B, 1C includes a closed magnetic circuit core 2 which has an excitation portion 2*a* and a non-excitation portion 2*b* and forms a hollow-rectangular-shaped closed magnetic circuit having sides, a primary coil 4 which has a conducting wire wound around a primary bobbin 3 surrounding the excitation portion 2*a* of the closed magnetic circuit core 2, and a secondary coil 6 which has a conducting wire wound around a secondary bobbin 5 surrounding the primary coil 4. Each hollow-rectangular-shaped closed magnetic circuit core 2 is formed of a plurality of thin metal plates in the form of electromagnetic steel plates laminated one over another. The non-excitation portion 2*b* of each closed magnetic circuit core 2 is overcoated with a buffer member 7 made of an elastic material such as resin, rubber, thermoplastic elastomer, etc. The buffer member 7 has a convexoconcave portion 7*a* formed on its surface which is in abutment with an inner wall surface of the casing 8.

The first through third transformers 1A, 1B, 1C in the casing 8 are fixedly attached to the casing 8 through the resin portion 11 made of a thermosetting resin such as an epoxy resin.

The conducting wire of each primary coil 4 has a primary coil connector terminal 40*a* formed at one end thereof which is connected with a corresponding module connector terminal 10*a* that is one of three first ends of a first wire 10A. The first wire 10A has a connector terminal 10*b* formed at the other or second end thereof which is electrically connected with an external connector terminal through which it is finally connected with a power supply (not shown) such as the battery of a vehicle. The conducting wire of each primary coil 4 also has a primary coil connector terminal 40*b* formed at the other end thereof which is connected with a module connector terminal 10*c* that is one end of a corresponding one of three second wires 10B. The other end of each second wire 10B forms a connector terminal 10*d* which is electrically connected with an external connector terminal, which is in turn finally connected with a corresponding terminal of a switching module (not shown), e.g., a collector of a corresponding one of power transistors which constitute the switching module.

The first wire 10A and the second wires 10B are integrally formed with each other through a resin to form the wiring module 9, as shown in FIG. 5. The wiring module 9 is formed with ribs 9*c* which are fitted into corresponding concave or recessed portions 40*c* formed in the primary coil connector terminals 40*a*. Here, note that the concave portions 40*c* and the ribs 9*c* together constitute a positioning means for positioning the relative positions of the primary coil connector terminals 40*a* and the module connector terminals 10*a*.

In addition, the wiring module 9 is formed with a connector housing 9*a* including connector terminals 10*b*, 10*d* for electrical connection with external equipment of the ignition apparatus for an internal combustion engine. The conductor housing 9*a* is formed at its base with an engagement portion 9*d* which is adapted to be engaged with an engagement portion 8*d* of the casing 8. The wiring module 9 has guide holes 9*b* formed therethrough into which insertion guide pins 8*c* of the casing 8 are adapted to be inserted.

The casing 8 has external output terminals 8*b* formed by insert molding which are to be connected with the secondary coil connector terminals 6*a* of an L-shaped cross section formed at the opposite ends of the conducting wire of each secondary coil 6. Each of the secondary coil connector terminals 6*a* is formed with a hole 6*b* into which a corresponding external output terminal 8*b* is to be press-fitted. The external output terminals 8*b* are electrically connected with spark plugs (not shown) through high-tension cords (not shown), respectively. Each secondary coil connector terminal 6*a* is fixedly attached to a fixed portion 5*a* of a corresponding secondary bobbin 5 through soldering or the like.

The respective closed magnetic circuit cores 2 of the first through third transformers 1A, 1B, 1C incorporated in the casing 8 are arranged along an axial direction B of the primary coils 4 and the secondary coils 6 in such a manner that the planes of the respective closed magnetic circuit cores 2 are disposed flush with one another and in parallel with the bottom surface of the casing 8. In addition, the respective closed magnetic circuit cores 2 are arranged in such a manner that the mutually adjacent non-excitation portions 2*b* partially overlap each other in the above-mentioned axial direction B. Moreover, the coil primary coils 4 and the secondary coils 6 arranged around excitation portions 2*a* of the mutually adjacent closed magnetic circuit cores 2 are provided on the excitation portions 2*a* which are mutually different sides in a zigzag form along the above-mentioned axial direction B.

The conductor module 9 is arranged over the first through third transformers 1A, 1B and 1C so as not to be superposed on the secondary coils 6.

Now, the operation of the ignition apparatus for an internal combustion engine as constructed above will be explained below.

First of all, the plurality of transformers 1A, 1B, 1C are arranged in the casing 8. At this time, the external output terminals 8*b*, which are insert molded with the casing 8, are press-fitted into the holes 6*b* in the secondary coil connector terminals 6*a*. Then, the engagement portion 8*d* of the casing 8 is engaged with the engagement portion 9*d* of the wiring module 9, and at the same time the insertion guide pins 8*c* of the casing 8 are inserted into the guide holes 9*b* in the wiring module 9. In this inserting operation, it is necessary to move the plurality of transformers 1A, 1B, 1C so that the ribs 9*c* of the wiring module 9 can be fitted into the concave portions 40*c* in the primary coil connector terminals 40*a*. When the ribs 9*c* are fitted into the concave portions 40*c*, the module connector terminals 10*a* of the first wire 10A and the primary coil connector terminals 40*a* are automatically placed into contact or abutment with each other.

Here, note that the positional relation between the module connector terminals 10*a* of the first wire 10A and the module connector terminals 10*c* of the second wires 10B is constant, and the positional relation between the primary coil connector terminals 40*a* and the primary coil connector terminals 40*b* are also constant. As a result, when the module connector terminals 10*a* of the first wire 10A and the primary coil connector terminals 40*a* are automatically placed into contact or abutment with each other, the primary coil connector terminals 40*b* and the module connector terminals 10*c* of the second wires 10B are also automatically placed into contact or abutment with each other. Accordingly, it is not necessary for one to take the trouble of individually adjusting the positions of the primary coil connector terminals 40*b* and the module connector terminals 10*c* of the second wires 10B.

After this, the module connector terminals 10*a*, 10*c* and the primary coil connector terminals 40*a*, 40*b* are connected with each other by welding.

Finally, a resin such as an epoxy resin is casted into the casing 8 under a vacuum atmosphere, and solidified or cured in a curing oven (not shown) at a high temperature to form the resin portion 11. In this manner, the fixing of the respective transformers 1A, 1B, 1C and the insulation of a high voltage can be achieved.

According to the ignition apparatus 100 for an internal combustion engine as constructed above, the respective closed magnetic circuit cores 2 are arranged in such a manner that the mutually adjacent non-excitation portions 2*b* partially overlap each other in the axial direction B of the primary coils 4 and the secondary coils 6. As a consequence, the length of the casing 8 in the axial direction B is shortened, thereby reducing the size and cost of the entire ignition apparatus.

In addition, the respective closed magnetic circuit cores 2 of the first through third transformers 1A, 1B, 1C incorporated in the casing 8 are arranged along the axial direction B in such a manner that the planes of the respective closed magnetic circuit cores 2 are disposed flush with one another and in parallel with the bottom surface of the casing 8. Accordingly, the miniaturization and cost reduction of the entire apparatus can be achieved by shortening the overall height of the casing 8.

Furthermore, the wiring module 9 is arranged over the transformers 1A, 1B, 1C in an area in which it is not superposed on the primary coils 4 and the secondary coils 6. Thus, the use of an empty space serves for effective utilization of the space as well as reduction in the overall size and manufacturing cost of the ignition apparatus.

Moreover, the non-excitation portions 2*b* of the closed magnetic circuit cores 2 are overcoated with the buffer members 7 made of an elastic material such as a resin, rubber, a thermoplastic elastomer, etc., so that stress due to thermal strain caused by a difference in the coefficients of linear expansion between the closed magnetic circuit cores 2 and the resin portion 11 under a thermal shock atmosphere can be absorbed by the buffer members 7, thus making it possible to prevent the generation of cracks in the resin portion 11.

In addition, each buffer member 7 has the convexoconcave portion 7*a* formed on its surface which is in abutment with an inner wall surface of the casing 8. Therefore, the contact area between each buffer member 7 and the inner wall surface of the casing 8 is small and hence the contact resistance therebetween becomes accordingly small. As a result, in the operation of connecting the primary coils 4 and the wiring module 9 with each other, the transformers 1A, 1B, 1C can be moved into the casing 8 without requiring a great driving force, thus making it possible to fit the ribs 9*c* into the concave portions 40*c* in an easy and simple manner.

Embodiment 2.

Although the ignition apparatus for an internal combustion engine according to the first embodiment is an ignition apparatus for an internal combustion engine in a simultaneously firing ignition system, the present invention can also be applied to an ignition apparatus for an internal combustion engine in an independently firing ignition system. In addition, the present invention can of course be applied to an ignition apparatus for an internal combustion engine with two or more transformers.

Moreover, ribs may be provided on the primary coils and concave portions may be provided in the wiring module for instance, as a positioning means for adjusting or positioning the relative positions of the primary coil connector terminals and the module connector terminals.

Furthermore, convexoconcave portions may be formed on the inner wall surface of the casing which is in abutment with the buffer members.

As described above, the present invention provides the following excellent advantages.

An ignition apparatus for an internal combustion engine according to the present invention includes: a casing; a closed magnetic circuit core incorporated in the casing and having sides; a primary coil arranged to surround part of the sides of the closed magnetic circuit core and having primary coil connector terminals at its opposite ends; a secondary coil arranged to surround the primary coil and having secondary coil connector terminals at its opposite ends for outputting a high voltage when a current supplied to the primary coil is turned on and off; a wiring module having module connector terminals connected with the primary coil connector terminals and being composed of a plurality of wires integrally formed with each other through a resin for supplying the current to the primary coil; a resin portion filled in the casing to fixedly attach the closed magnetic circuit core, the primary coil and the secondary coil to an inner surface of the casing; and positioning means arranged between the primary coil and the wiring module for positioning the relative positions of the primary coil connector terminals and the module connector terminals. With the above arrangement, the positional adjustment of the primary coil connector terminals and the module connector terminals can be easily performed, as a result of which it is possible to carry out the operation of electrically connecting the primary coil and the wiring module with each other in a smooth manner.

In a preferred form of the present invention, the positioning means includes concave portions formed in the primary coil connector terminals, and ribs formed on the wiring module and fitted into the concave portions. Thus, with a simple construction, it is possible to adjust or position the relative positions of the primary coil connector terminals and the module connector terminals.

In another preferred form of the present invention, the casing has external output terminals which are connected with the secondary coil connector terminals, respectively, and formed by insert molding. Thus, the external output terminals can be prevented from being mutually moved toward each other during assembly and production, thus avoiding leakage of an output voltage. Consequently, the reliability of the ignition apparatus is improved.

In a further preferred form of the present invention, a buffer member is arranged to surround a part of the sides of the closed magnetic circuit core for buffering thermal stress generated in the resin portion. Thus, stress due to thermal strain caused by a difference in the coefficients of linear expansion between the closed magnetic circuit core and the resin portion under a thermal shock atmosphere can be absorbed by the buffer member, thus making it possible to prevent the generation of cracks in the resin portion.

In a still further preferred form of the present invention, a convexoconcave portion is formed on one of the buffer member and a surface of the casing which is in contact with the buffer member for reducing an area of contact between the buffer member and the casing. Thus, the contact area between the buffer member and the inner wall surface of the casing is small, accordingly reducing the contact resistance therebetween. As s result, in the operation of connecting the primary coil and the wiring module with each other, the closed magnetic circuit core, the primary coil and the secondary coil can be moved into the casing without requiring a great driving force, thereby making it possible to carry out the positional adjustment of the primary coil connector terminals and the module connector terminals in a simple and easy manner.

While the invention has been described in terms of preferred embodiments, those skilled in the art will recognize that the invention can be practiced with modifications within the spirit and scope of the appended claims.

What is claimed is:

1. An ignition apparatus for an internal combustion engine comprising: a casing; a closed magnetic circuit core incorporated in said casing and having sides; a primary coil arranged to surround part of the sides of said closed magnetic circuit core and having primary coil connector terminals at its opposite ends; a secondary coil arranged to surround said primary coil and having secondary coil connector terminals at its opposite ends for outputting a high voltage when a current supplied to said primary coil is turned on and off; a wiring module having module connector terminals connected with said primary coil connector terminals and being composed of a plurality of wires integrally formed with each other through a resin for supplying the current to said primary coil; a resin portion filled in said casing to fixedly attach said closed magnetic circuit core, said primary coil and said secondary coil to an inner surface of said casing; and positioning means arranged between said primary coil and said wiring module for positioning the relative positions of said primary coil connector terminals and said module connector terminals.

2. The ignition apparatus for an internal combustion engine according to claim 1, wherein said positioning means comprises concave portions formed in said primary coil connector terminals, and ribs formed on said wiring module and fitted into said concave portions.

3. The ignition apparatus for an internal combustion engine according to claim 1, wherein said casing has external output terminals which are connected with said secondary coil connector terminals, respectively, and formed by insert molding.

4. The ignition apparatus for an internal combustion engine according to claim 1, wherein a buffer member is arranged to surround a part of the sides of said closed magnetic circuit core for buffering thermal stress generated in said resin portion.

5. The ignition apparatus for an internal combustion engine according to claim 4, wherein a convexoconcave portion is formed on one of said buffer member and a surface of said casing which is in contact with said buffer member for reducing an area of contact between said buffer member and said casing.

* * * * *